US006554364B1

(12) United States Patent
Dammermann et al.

(10) Patent No.: US 6,554,364 B1
(45) Date of Patent: Apr. 29, 2003

(54) ARTICULATING ARMREST

(75) Inventors: Arnold B. Dammermann, Grand Rapids, MI (US); David A. Bodnar, Jenison, MI (US); Michael L. Deimen, Grand Rapids, MI (US); Thomas R. Hahn, Kentwood, MI (US); Duane F. Nagel, Grand Rapids, MI (US); Charles P. Roossien, Wyoming, MI (US); David L. Rundhaug, Grand Rapids, MI (US); David S. Teppo, Grand Rapids, MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 08/390,698

(22) Filed: Feb. 17, 1995

(51) Int. Cl.[7] ..... A47C 7/54

(52) U.S. Cl. ..... 297/411.37; 297/411.35; 297/411.38

(58) Field of Search ..... 297/391, 403, 297/409, 411.34, 411.35, 411.37, 406, 407, 411.32, 116, 411.38; 248/118, 118.5; 403/109

(56) References Cited

U.S. PATENT DOCUMENTS

| | | | | | |
|---|---|---|---|---|---|
| 248,919 | A | * | 11/1881 | Crosgrave | 297/116 X |
| 278,004 | A | * | 5/1883 | Farrar | 297/116 |
| 311,854 | A | | 2/1885 | Roush | |
| 455,168 | A | | 6/1891 | Case | |
| 461,928 | A | | 10/1891 | White | |
| 533,619 | A | | 2/1895 | Stuebing | |
| 542,390 | A | | 7/1895 | Linn | |
| 627,516 | A | | 6/1899 | Morgan | |
| 709,945 | A | * | 9/1902 | Wade | 297/116 |
| 1,025,476 | A | | 5/1912 | Mellen | |
| 1,699,894 | A | | 1/1929 | Klemm | |
| 1,717,568 | A | * | 6/1929 | Koennigkramer | 297/403 X |
| 1,721,221 | A | * | 7/1929 | Jauregui | 297/411.35 X |

(List continued on next page.)

FOREIGN PATENT DOCUMENTS

| | | | | |
|---|---|---|---|---|
| CA | 722004 | * | 11/1965 | 297/411.34 |
| DE | 808151 | * | 5/1951 | 297/116 |
| DE | 1555868 | * | 7/1969 | 297/391 |
| DE | 2120807 | * | 11/1972 | 297/391 |
| DE | 2845976 | * | 4/1980 | 297/391 |
| DE | 3407776 | * | 9/1985 | 297/391 |
| EP | 0273194 | * | 7/1988 | 403/109 |
| FR | 2352687 | * | 5/1976 | 297/391 |
| FR | 2302705 | * | 10/1976 | 297/406 |
| FR | 2392578 | * | 1/1979 | 297/391 |
| FR | 2428538 | * | 2/1980 | 297/391 |
| GB | 7564 | * | of 1897 | 297/116 |
| GB | 3056 | * | of 1901 | 297/116 |
| GB | 9457 | * | of 1914 | 297/116 |
| GB | 2132479 | * | 7/1984 | 297/403 |
| GB | 2148422 | | 5/1985 | |
| JP | 0182715 | * | 10/1984 | 297/391 |
| SU | 1729456 | * | 4/1992 | 297/116 |
| WO | 86003167 | * | 6/1986 | 297/411.35 |

*Primary Examiner*—Milton Nelson, Jr.
(74) *Attorney, Agent, or Firm*—Price Heneveld Cooper Dewitt & Litton

(57) ABSTRACT

An armrest structure includes a support and a body rotatably mounted on the support. The support includes a pair of protrusions and the body includes a notched channel for receiving the protrusions. By rotating the body on the support, the protrusions are repositioned in the notched channel between selected stable use positions. The notches are located on both sides of the channel such that the body can be located in a first position with the first surface on the body facing generally upwardly for use, and a second position with the second surface on the body facing generally upwardly for use. By varying the surfaces on the body, and also the engagement of the protrusion with the notched channel, various spacial positions and functional surfaces can be selectively positioned for use.

56 Claims, 7 Drawing Sheets

U.S. PATENT DOCUMENTS 1,842,208 A * 1/1932 Schneider ..... 297/116
1,922,502 A * 8/1933 Scragg ..... 297/116
2,030,635 A 2/1936 Horwitt
2,072,791 A 3/1937 Baer
2,483,396 A * 10/1949 Benson ..... 403/109 X
2,549,902 A 4/1951 Hibbard et al.
2,652,101 A * 9/1953 Samsky et al. ..... 297/409 X
2,748,261 A 5/1956 Wolar
2,803,219 A 8/1957 Stoeberl
2,815,067 A 12/1957 Richardson
2,841,212 A * 7/1958 De Vos et al. ..... 297/411.37 X
2,865,430 A 12/1958 Folkner
3,028,196 A * 4/1962 Kitsopoulos ..... 297/116
3,036,864 A 5/1962 Arai
3,140,119 A * 7/1964 Offner ..... 297/411.35 X
3,142,194 A 7/1964 Garden
3,179,071 A 4/1965 Johnston
3,215,470 A 11/1965 Swenson et al.
3,271,073 A 9/1966 Van Buren, Jr.
3,292,972 A 12/1966 Krueger
3,312,440 A 4/1967 Zelony
3,371,956 A * 3/1968 Jordan et al. ..... 297/411.34 X
3,376,068 A 4/1968 Walkinshaw
3,469,870 A 9/1969 Barkus
3,519,291 A * 7/1970 Scott ..... 403/109 X
3,747,976 A 7/1973 Lacey
3,950,026 A * 4/1976 Van Seenus ..... 297/411.37 X
3,989,298 A 11/1976 Cycowicz et al.
3,990,745 A 11/1976 Rodaway
4,012,158 A 3/1977 Harper
4,036,525 A 7/1977 Howk
4,153,296 A 5/1979 Rhamstine
4,159,148 A 6/1979 Schulz
4,221,430 A 9/1980 Frobose
4,277,102 A 7/1981 Aaras et al.
4,411,471 A * 10/1983 Ponzellini ..... 297/411.34
4,451,084 A 5/1984 Seeley
4,546,668 A 10/1985 Mattsson
4,573,737 A 3/1986 Korn
4,576,351 A 3/1986 Brink
4,659,135 A 4/1987 Johnson
4,660,885 A 4/1987 Suhr et al.
4,707,026 A 11/1987 Johansson
4,720,142 A 1/1988 Holdredge et al.
4,744,603 A 5/1988 Knoblock
4,750,784 A 6/1988 Schwartz
4,787,405 A * 11/1988 Karowski ..... 403/109 X
4,793,611 A 12/1988 Thornell
4,815,688 A 3/1989 Wood
4,822,103 A 4/1989 Stenvall
4,828,323 A 5/1989 Broderson et al.
4,844,544 A * 7/1989 Ochiai ..... 297/391 X
4,911,501 A 3/1990 Decker et al.
4,917,438 A * 4/1990 Morgan ..... 297/116 X
4,961,610 A 10/1990 Reeder et al.
4,966,412 A 10/1990 Dauphin
5,035,466 A 7/1991 Mathews et al.
5,046,780 A 9/1991 Decker et al.
5,056,863 A 10/1991 DeKraker et al.
5,106,157 A 4/1992 Nagelkirk et al.
5,143,422 A 9/1992 Althofer
5,215,282 A 6/1993 Bonutti
5,265,938 A 11/1993 Melhuish et al.
5,281,001 A 1/1994 Bergsten et al.
5,318,346 A 6/1994 Roossien et al.
5,333,368 A 8/1994 Kriener et al.
5,368,364 A 11/1994 Kanai
5,380,065 A 1/1995 Rohrer
5,382,079 A 1/1995 Wilson et al.
5,385,388 A 1/1995 Faiks et al.
5,393,124 A 2/1995 Neil
5,415,459 A 5/1995 Schultz
5,542,746 A * 8/1996 Bujaryn ..... 297/411.32 X
5,549,407 A * 8/1996 Levi et al. ..... 403/109
5,586,810 A * 12/1996 Liu ..... 297/406
5,612,718 A * 3/1997 Bryan ..... 297/411.35 X

* cited by examiner

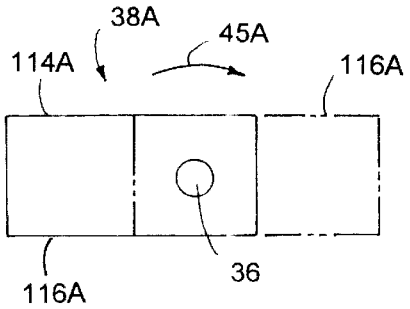
FIG. 17
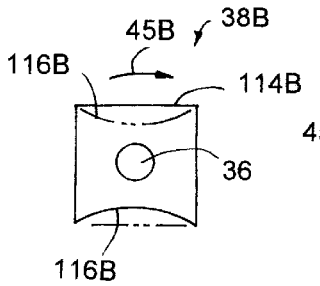
FIG. 18
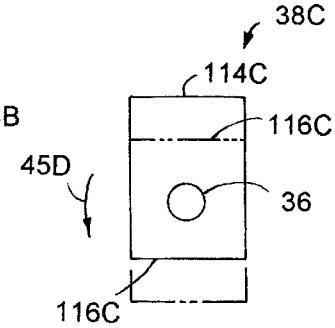
FIG. 19
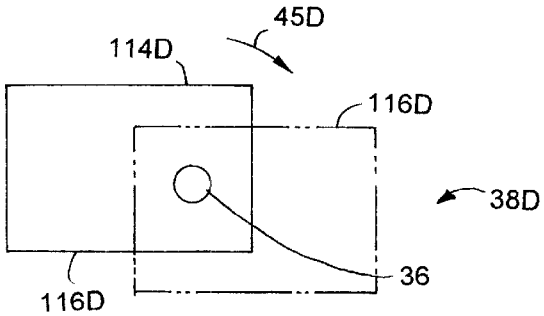
FIG. 20
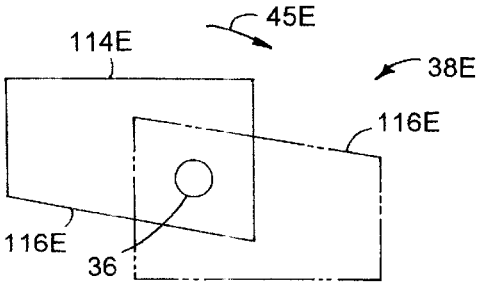
FIG. 21
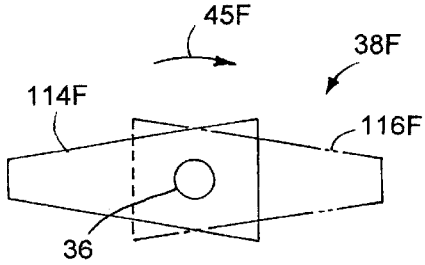
FIG. 22
FIG. 14
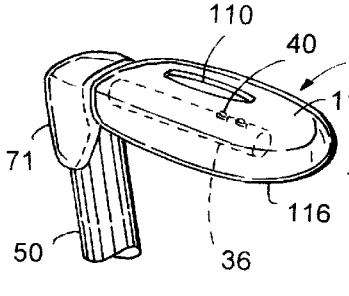
FIG. 15
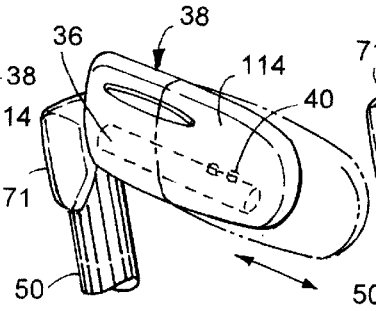
FIG. 16
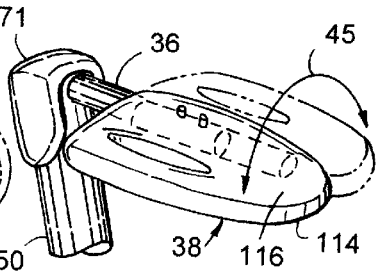

ARTICULATING ARMREST

CROSS REFERENCE TO RELATED APPLICATIONS

This application is related to co-pending patent applications entitled "MODULAR CHAIR CONSTRUCTION AND METHOD OF ASSEMBLY", Ser. No. 08/390,118, filed Feb. 17, 1995, now U.S. Pat. No. 5,782,536, in the name of inventors Kurt R. Heidmann et al.; "SEATING UNIT" (design), Ser. No. 29/035,048 filed Feb. 17, 1995, now U.S. Pat. No. D 369,579, in the name of inventors Arnold B. Dammermann et al.; and "SEATING UNIT" (design), Ser. No. 29/035,045, filed Feb. 17, 1995, now U.S. Pat. No. D 383,322 in the name of inventors Arnold B. Dammermann et al., each of the co-pending applications being filed on even date herewith, each being assigned to assignee of the present application, and the entire contents of each co-pending application being incorporated herein in its entirely.

BACKGROUND OF THE INVENTION

The present invention concerns an armrest and more particularly, concerns an armrest having a movable multi-surfaced body that can be repositioned for multi-functional use, ergonomics, and convenience.

A variety of armrests are known that include an adjustable component movable between various positions. The least complex of such armrests are mechanically relatively simple, but provide only a limited range of positions along a single path of adjustment. The more complex of such armrests offer more versatility, but are cumbersome to operate or use, and/or are not satisfactorily stable when locked in a selected position. Notably, even relatively non-complex adjustments can become burdensome to make where a person repeatedly alternates between different tasks during a work day. Additionally, the mechanisms supporting the movement tend to include multiple parts which are expensive to assemble, maintain, and repair.

Aside from movable armrests and mechanisms for permitting movement,.it is difficult to provide a single "universal" surface or interface on an armrest capable of satisfactorily meeting multiple needs of a person sitting in a chair. For example, the armrests in a task chair may need to vertically support a person's arm generally beside the person when performing a first task, such as when working from a worksurface, but may preferably need to support a person's forearm at an inward position generally in front of the person for performing a second task, such as when tying on a keyboard located centrally in front of the person.

Thus, armrests solving the aforementioned problems are desired. Further, armrest structures are desired that allow armrests to provide differently configured surfaces to satisfy different needs.

SUMMARY OF THE INVENTION

An aspect of the present invention is to provide an armrest structure that includes a support and an armrest body having a plurality of user interface faces defined thereon. The body is movably attached to the support in a manner allowing each of the faces to be selectively positioned in an operative position for use by the user. In one form, the armrest body is rotatably mounted on the support for movement about a horizontal axis between a first position where a first surface on the armrest body is positioned for use and a second position where a second surface on the armrest body is positioned for use.

These and other features, advantages and objects of the present invention will be further understood and appreciated by those skilled in the art by reference to the following specification, claims and appended drawings.

BRIEF DESCRIPTION OF THE DRAWINGS

FIGS. 14–16 are perspective views showing adjustment of the armrest body on the support from an outwardly pivoted first latched/use position (FIG. 14) to a released position (FIG. 15), to an extended inwardly pivoted second latched/use position (FIG. 16);

FIGS. 17–22 are end schematic views showing alternative armrest body cross-sectional shapes in a first position in solid lines and a second position in dashed lines;

DETAILED DESCRIPTION OF PREFERRED EMBODIMENT

Figure 1:
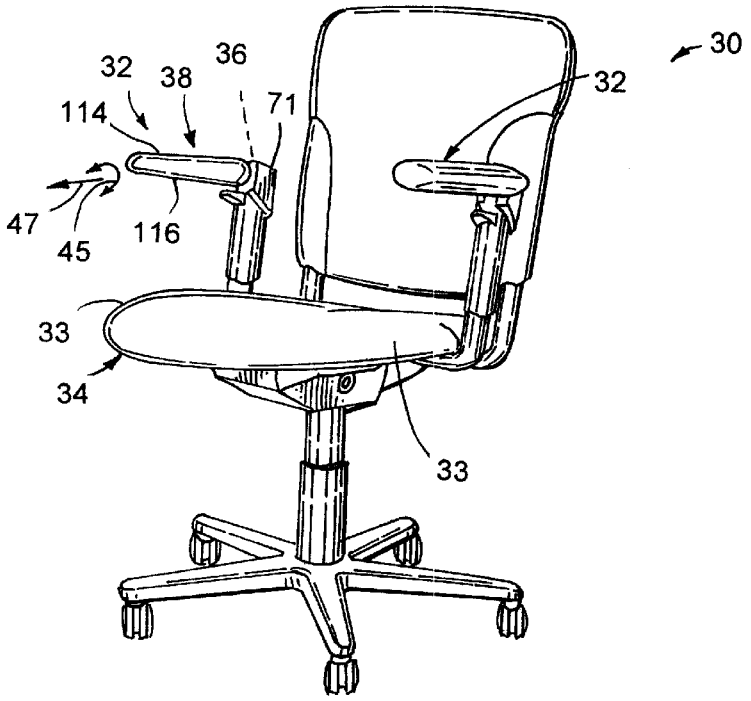
FIG. 1 is a perspective view of a chair including armrest structures embodying the present invention.

A chair 30 (FIG. 1) includes a pair of armrest structures 32 mounted in spaced relation above and generally over an edge 33 of a seat 34. Armrest structures 32 each include a support 36 and further include a body 38 rotatably mounted on the support 36. The support 36 includes a pair of protrusions 40 (FIG. 2) and the body 38 includes a notched stop-rack-defining depression 42 for receiving the protrusions 40. By rotating the body 38 on the support 36, the depression 42 is moved around relative to protrusions 40 between a plurality of selectable, stable use positions where the protrusions 40 engage selected notches 44 in the depression 42. Body 38 is further rotatably moveable to a disengaged/released position (FIG. 15) where the body 38 is telescopingly slidable on support 36. A plurality of notches 44 (FIG. 2) are located on both sides of the depression 42 such that the body 38 can be rotated from a released position (such as shown in FIG. 15) along arrow 45 to an outwardly oriented first position with a first surface or interface face or surface 114 on the body 38 facing generally upwardly for use, or an inwardly oriented second position with a second interface face or surface 116 on the body 38 facing generally upwardly for use. Thus, the body 38 can be readily manipulated to various locations and positions, with different surfaces on the body 38 being placed in various operative user interfacing positions depending upon which notch 44 is selected.

More specifically, armrest structure 32 (FIG. 2) includes a metal arm 50 welded or otherwise secured to support 36. Arm 50 includes a lower end configured to engage the chair 30 for holding support 36 in a desired position on chair 30. Various arm configurations are possible and are contemplated to be within the scope of the present invention. For example, arm 50 may be vertically adjustable, such as by incorporating the structure shown in co-pending commonly assigned. U.S. patent application Ser. No. 08/069,289, filed May 28, 1993, entitled "HEIGHT ADJUSTABLE CHAIR ARM ASSEMBLY" and in co-pending commonly assigned U.S. patent application Ser. No. 08/069,172, filed May 28, 1993, entitled "CHAIR WITH ADJUSTABLE ARMS", the entire contents of both of which are incorporated herein by reference. Armrest structure 32 defines an inverted "L" shape. However, other shapes are possible such as loop shapes, inverted "U" shapes and the like.

Figure 2:
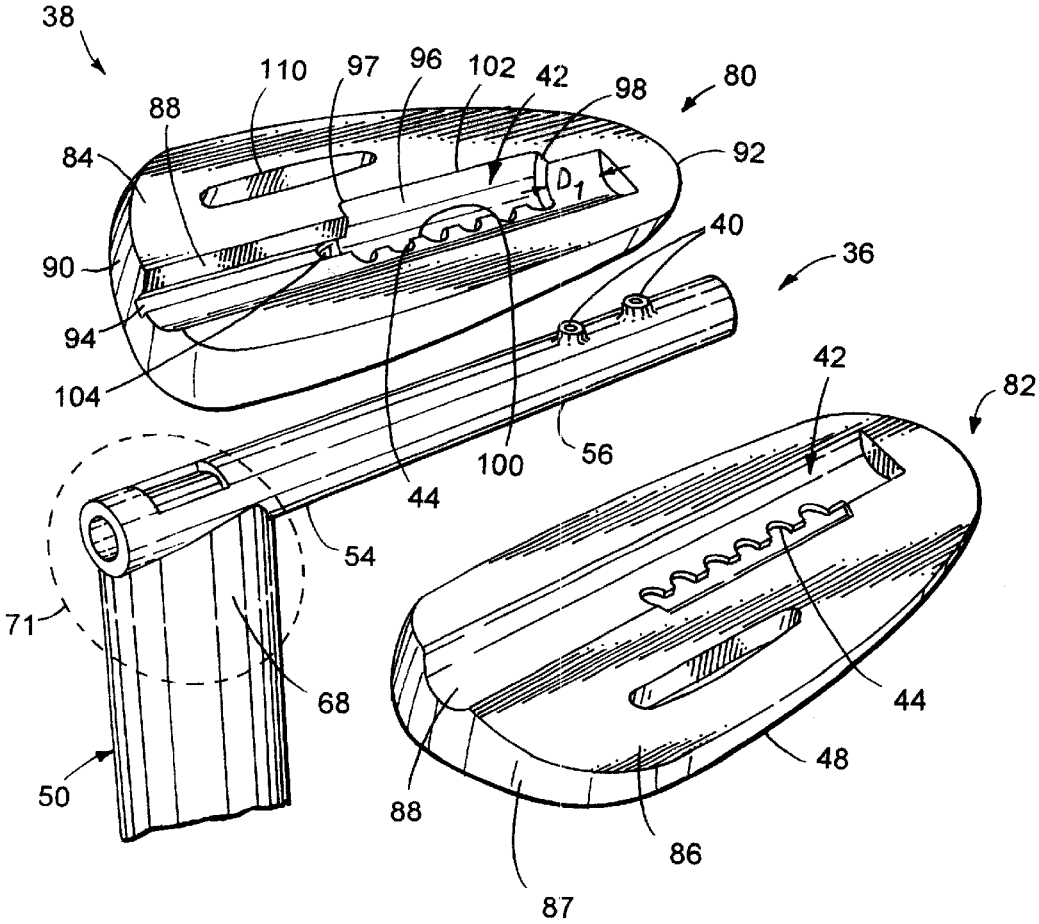
FIG. 2 is an exploded perspective view of the armrest structure shown in FIG. 1.
Figure 7:
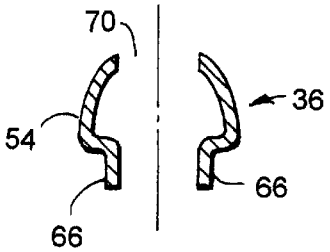
FIG. 7 is a cross-sectional view taken along the plane VII—VII in FIG. 4.
Figure 6:
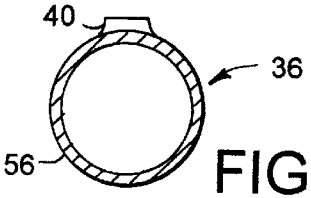
FIG. 6 is a cross-sectional view take n along the plane VI—VI in FIG. 4.
Figure 11:
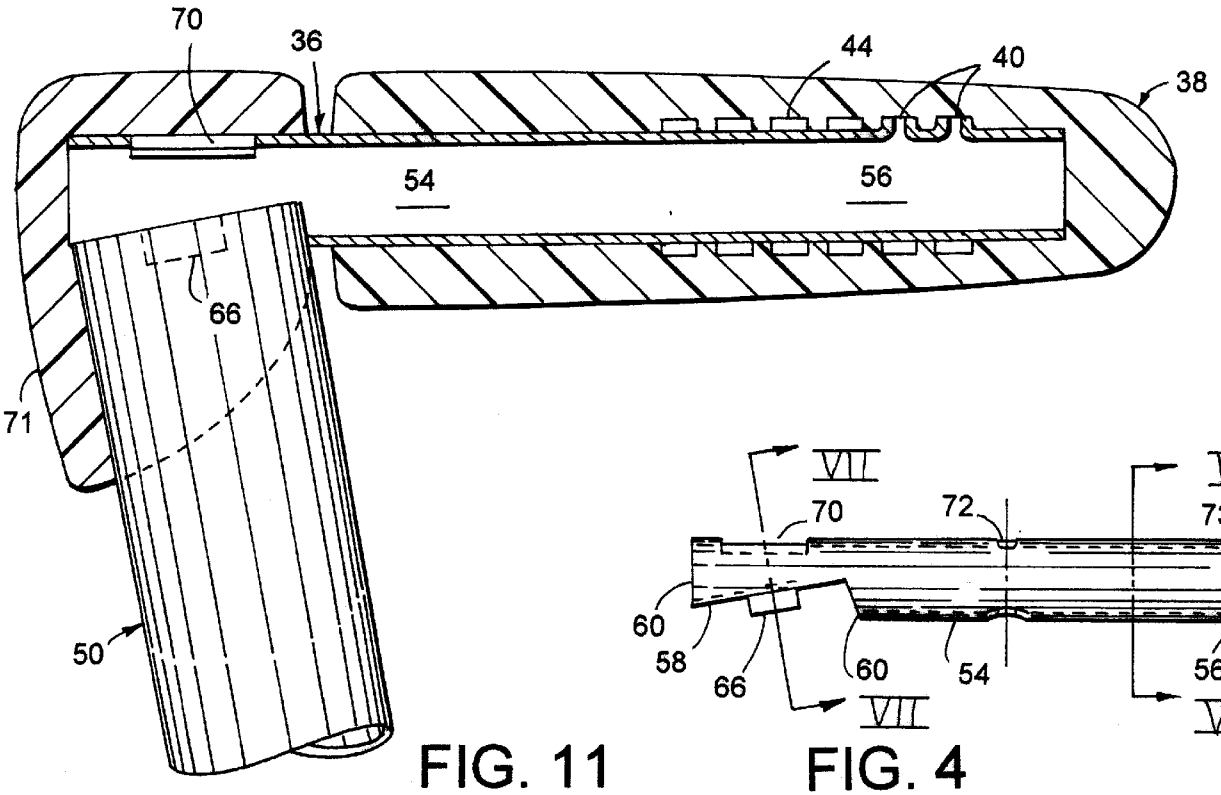
FIG. 11 is a cross-sectional view taken along the plane XI—XI in FIG. 10.
Figure 4:
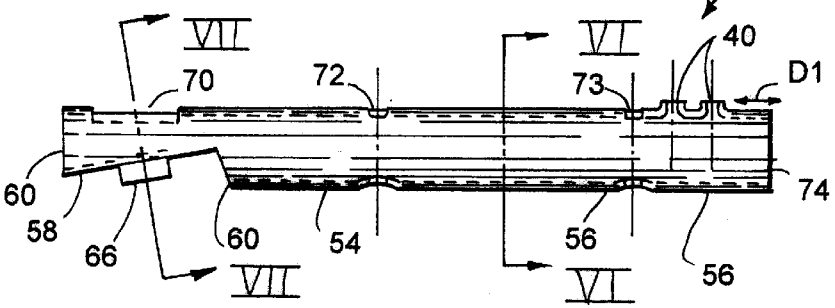
FIG. 4 is a side view of the support shown in FIG. 3.
Figure 5:
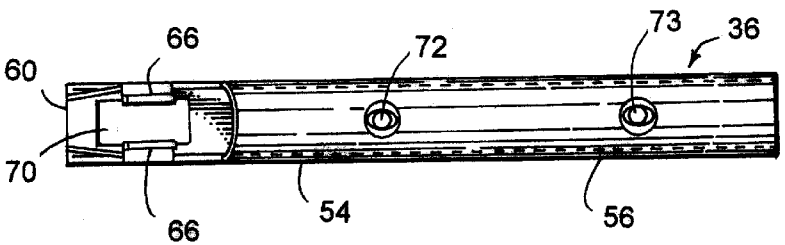
FIG. 5 is a bottom view of the support shown in FIG. 3.

Support 36 (FIG. 2) is a round tubular member having a first end section 54 for engaging arm,50 and a second end section 56. operably supporting body 38. First end section 54 (FIG. 4) includes an angled notch 58 along its bottom surface extending from a rear end 60 of support 36 to a location 62 a distance from end 60. Attachment tabs 66 extend downwardly for mateably engaging the top 68 of arm 50 (FIG. 2). An access aperture 70 (FIG. 4) is formed in first end section 54 above notch 44 to facilitate attachment of support 36 to arm 50, such as to permit welding along the perimeter of notch 44 and on tabs 66. An aesthetic covering 71 (FIGS. 2 and 11) surrounds first end section 54 and also surrounds the upper portion of arm 50 immediately therebelow. Second end section 56 (FIG. 4) includes a pair of spaced apart locating holes 72 and 73 positioned midway along support 36 for receiving screws, such that support 36 can be used to support a fixed, non-rotatable armrest body. However, the holes 72 and 73 are not used with rotatable armrest body 38.

The pair of protrusions 40 are formed in second end section 56 approximate the free end 74 of end section 56, but spaced therefrom a distance D1. It is contemplated that depending on the design of body 38 and its functional requirements, only one protrusion 40 may need to be used. However, the illustrated embodiment includes two such protrusions 40 to provide additional locking and rotation-limiting support structure. Protrusions 40 are formed by extruding tube material from support 36 outwardly from the top of support 36. Notably, it is contemplated that protrusions 40 and rack-defining depression 42 can be reversed, such that protrusions 40 are located on armrest body 38 and depression 42 is located on support 36. Alternatively, other techniques or operations may be used to form protrusions 40, such as by use of rivets or the like. Still further, protrusions 40 can be relocated and/or the cavity within body 38 can be redesigned or canted to locate body 38 at various selectable angled use positions. Additionally, a retractable protrusion would allow minimization or elimination of keyway channel 94, discussed below. For example, it may be desirable to position armrest body 38 successively angularly lower as it is moved forwardly on support 36. Also, it is contemplated that a support having retractable protrusions could be constructed. The retractable protrusions would be releasably disengageable from holes or other depressions in the armrest body. This would allow armrest body to be rotated 360° between a variety of selectable use positions. For example, the retractable protrusion could be a spring biased ball and socket detent-type arrangement, or the support could include a release mechanism actuatable from an end of the support for retracting the retractable protrusion.

Figure 8:
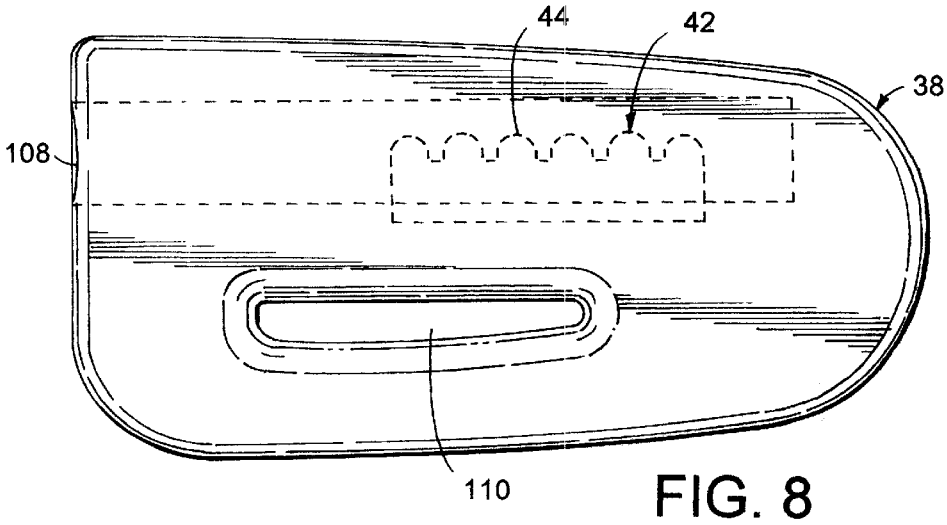
FIG. 8 is a plan view of the armrest body shown in FIG. 1.
Figure 9:
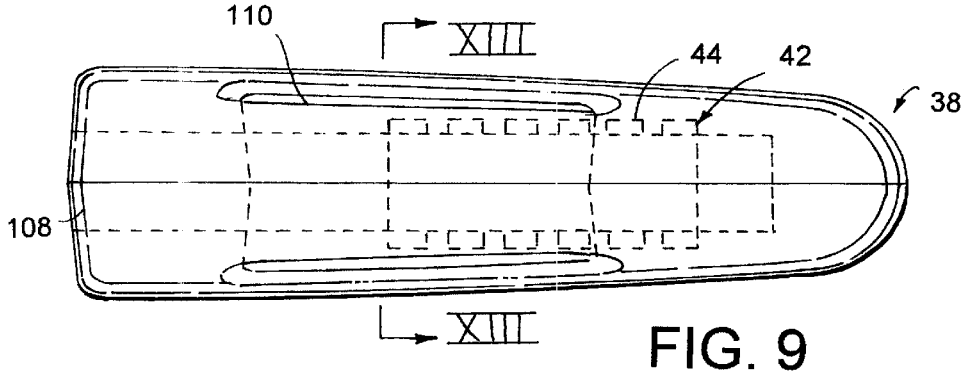
FIG. 9 is a side view of the armrest body shown in FIG. 8.

Body 38 (FIGS. 8–9) is an aesthetically-shaped member formed from foamed, polymeric materials. Various processes and materials can be used to manufacture body 38, such as by adhering a resilient cushion to a depression-defining sheet metal or structural polymeric core component, by molding a self-skinning rigid foam material, by forming a resilient cushion around an injection molded polymeric core, by injection molding a bulbous shell having a bore therein, and the like.

The illustrated armrest body 38 includes opposing members 80 and 82 (FIG. 2) that are molded from structural material. Opposing members 80 and 82 are configured to mateably engage so that they can be covered with reaction injection molded (RIM) material, such as self-skinning foamed polyurethane. The RIM material is resilient, yet relatively stiff, particularly in the plane of the skin. In FIG. 2, armrest body 38 is shown as though it has been cut apart longitudinally with member 80 being on one side and member 82 being on the other side, but with the RIM material also being shown as adhered to the members 80 and 82.

Opposing member 80 (FIG. 2) includes a semi-cylindrical channel 88 that extends from the arm-adjacent end 90 of body 38 to a location proximate but spaced from the free end 92 of body 38. A keyway channel 94 extends axially along the length of channel 88. The depth and width of keyway channel 94 is equal to or slightly greater than the corresponding dimensions of protrusions 40 so that protrusions 40 can slide along keyway channel 94. A circumferentially extending half section 96 of depression 42 is formed in armrest body 38. Depression half section 96 includes an enlarged quarter cylinder section that is axially aligned and concentric with channel 88, and which extends about 80° from planar surface 84 to a bottom of semi-cylindrical channel 88. Depression half section 96 is formed from about a midpoint 97 of channel 88 axially to a location 98 spaced a distance D1 from the end of channel 88. Depression half section 96 is radially sufficiently deep to accommodate the protrusions 40. A series of notches 44 form a stop rack at the bottom edge 100 of depression half section 96. Notches 44 are shaped and spaced a predetermined distance apart to mateably receive protrusions 40. Notches 44 form a plurality of discrete stops selectively engageable by the protrusions 40 to limit the rotation of body 38 on support 36. Notches 44 are located in a longitudinally aligned arrangement, although it is noted that the notches could be canted or could be located in a non-aligned arrangement along a non-longitudinal path to define various angular positions for armrest body 38. The opposite edge 102 of depression half section 96 opens into planar surface 84 so that protrusions 40 can be moved to either side of depression 42.

An inclined retainer 104 is positioned in keyway channel 94 to allow protrusions 40 to slide along keyway channel 94 into depression half section 96 after body members 80 and 82 are assembled. The inclined retainer 104 is shaped to cause the protrusions 40 to ramp over inclined retainer 104 when support 36 is being inserted into body 38, but is further shaped to prevent disassembly by providing a blunt surface that abuttingly engages protrusions 40 when engaged from a direction opposite the insertion direction.

Figure 3:
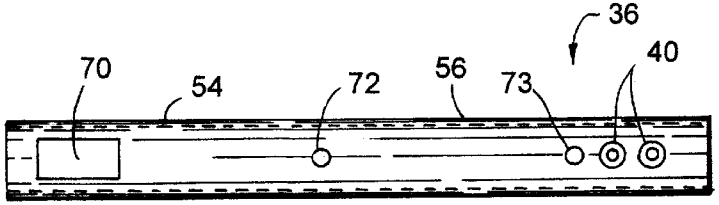
FIG. 3 is a top view of the support shown in FIG. 2.

Body member 82 (FIG. 2) is a mirror image of body member 80, except body member 82 does not include an inclined retainer 104 nor a keyway channel 94. When body members 80 and 82 are secured together, channels 88 combine to form a cylindrical bore 108 (FIG. 8) for slidingly and rotatably receiving support 36 (FIG. 3). Bore 108 forms a bearing surface for slidably rotatingly supporting body 38 on support 36. A lubricant can be spread onto bore 108 if desired, or a lubricous sleeve insert can be placed in bore 108 to provide lubricity while also reinforcing bore 108. However, it is contemplated that neither will be required as the material of members 80 and 82 is naturally lubricous. The depressions 42 form a semicircularly-shaped, double-sided stop rack 109 (FIG. 8) engageable by protrusions 40. Members 80 and 82 can be secured together by adhesive, screws, clips or the like. As assembled, body 38 includes a first surface 114 for supporting a person's arm when in a first use position (FIG. 14) and a second surface 116 for supporting a person's arm when in a second position (FIG. 16). A finger hold or aperture 110 (FIG. 8) is defined in the offset lobe 112 of body 38 spaced radially from bore 108. Notably, aperture 110 can be enlarged, such as for providing a cupholder aperture for holding a container, or can be reshaped, such as for providing a depression for holding a pencil or paper clips.

Figure 10:
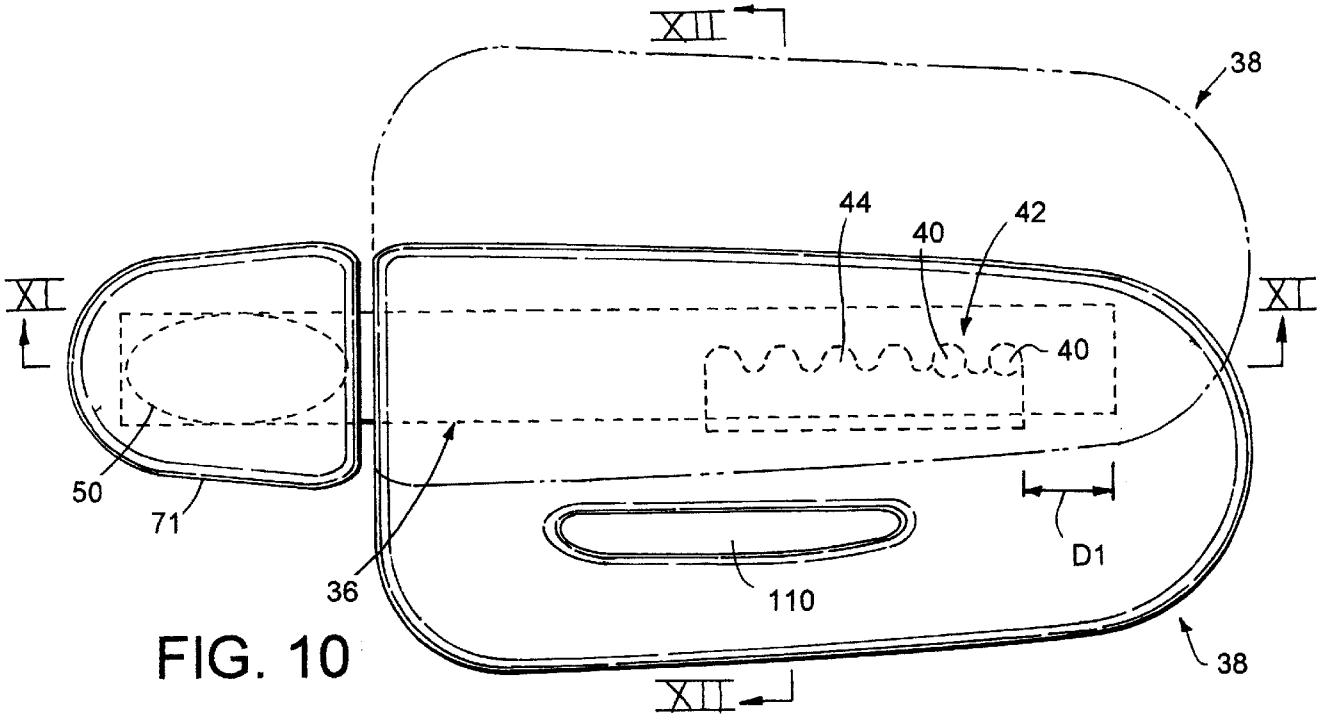
FIG. 10 is a plan view of the armrest structure shown in FIG. 1, the armrest body being shown in a first position in solid lines and in a second position in dashed lines.
Figure 12:
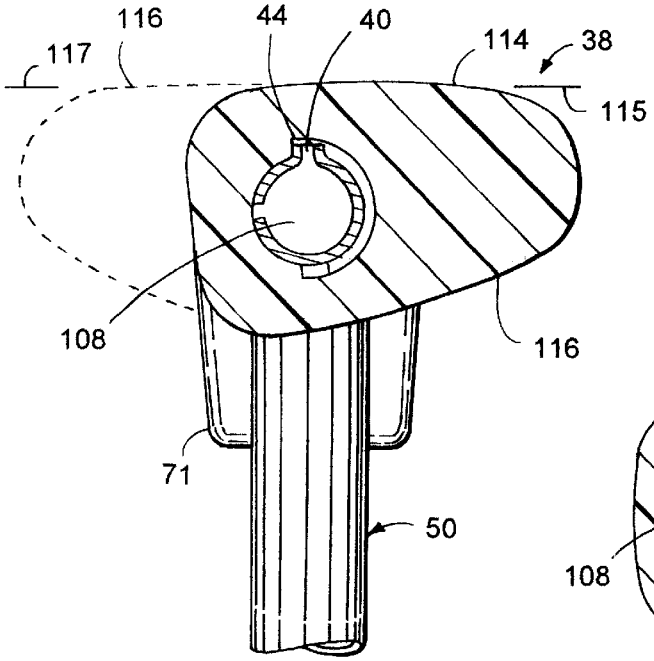
FIG. 12 is a cross-sectional view of the armrest structure taken along the plane XII—XII in FIG. 10.
Figure 13:
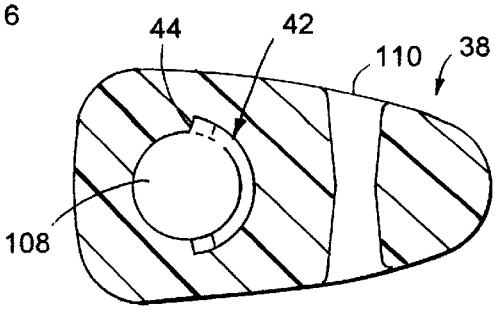
FIG. 13 is a cross-sectional view taken along the plane XIII—XIII in FIG. 9.
Figure 23:
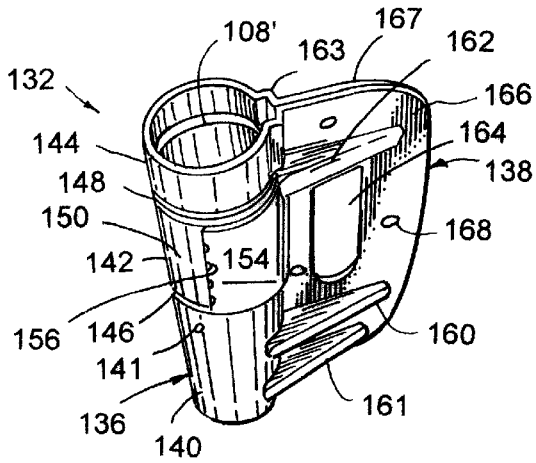
FIG. 23 is a perspective view of a reinforcement insert for a modified armrest body.
Figure 24:
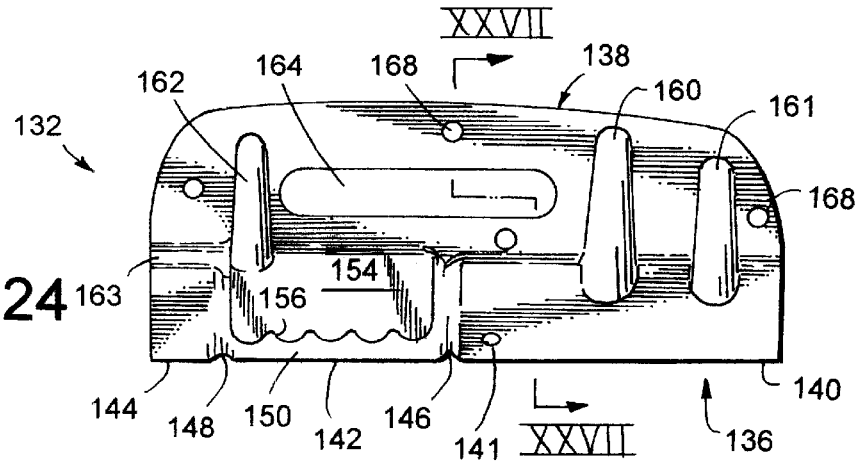
FIG. 24 is a plan view of the reinforcement insert shown in FIG. 23.
Figure 25:
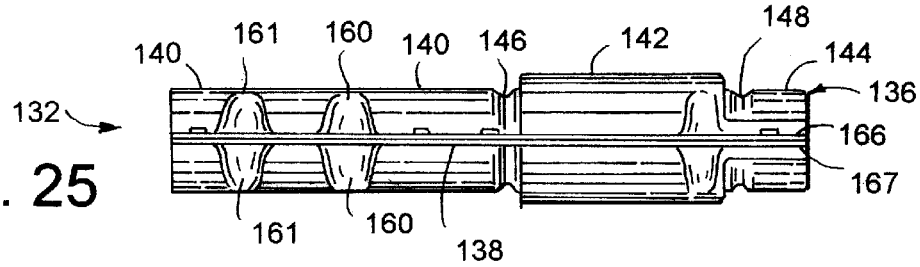
FIG. 25 is a side view of the apertured side of the reinforcement insert shown in FIG. 23.
Figure 26:
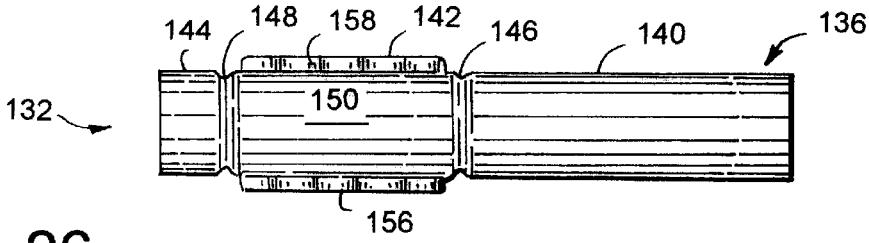
FIG. 26 is a side view of the tubular side of the reinforcement insert shown in FIG. 23.

Bore 108 (FIG. 13) formed by the combination of channels 88 is located in an offset portion in body 38. Thus, first surface 114 occupies a first spacial position when body 38 is rotated to the first locked/use position (FIGS. 10, 12 and 13, solid lines) and second surface 116 occupies a second spacial position different from the first spacial position when body 38 is rotated to the second locked/use position (FIGS. 10, 12 and 13, dashed lines). Further, it is noted that surfaces 114 and 116 are generally horizontally oriented along lines 115 and 117, respectively, when in the respective use positions (see FIG. 13), first surface 114 being positioned in an outward direction from support 36 and second surface 116 being positioned in an inward direction from support 36. It is also contemplated that one or both of surfaces could be constructed to be oriented in an inclined position or otherwise positioned, when in their respective use positions, as discussed hereinafter.

Body 38 (FIG. 2) is assembled to support 36 by sliding body 38 onto the free end 56 of support 36 with protrusions 40 being aligned with and sliding into keyway channel 94. As protrusions 40 ramp onto and over inclined retainer 104, they lock within the cavity defined by depression 42. To operate armrest structure 30, body 38 is initially rotated a few degrees to a disengaged position (FIG. 15) wherein protrusions 40 are released from notches 44 in depression 42. This allows body 38 to be slidingly moved axially, longitudinally along support 36. Once body 38 is axially positioned on support 36 in a selected longitudinal position, body 38 is rotatable through an angular stroke of about 160° such that body 38 extends inwardly partially over the seat of a chair (FIG. 16) or such that body 38 extends generally outwardly from the seat (FIG. 14).

By selecting different shapes for the armrest body, and by locating the support 36 at various offset positions in the body, the interface faces of the body will be located in different spacial positions as the body is pivoted between first and second positions. In FIGS. 17–22, armrest bodies 38A–38F are shown schematically in solid lines when in a first position and in dashed lines when rotated along arrows 45A–45F, respectively, to a second position. To simplify FIGS. 17–22, the armrest shapes and surfaces are shown as relatively simple geometric shapes having planar sides, but it is noted that complex, contoured shapes are also possible. Armrest body 38A (FIG. 17) has a laterally elongated rectangular shape, and the support 36 is offset laterally, such that the first surface 114A when in the first position is horizontally co-planar but offset from the spacial position of second surface 116A when in the second position. Armrest body 38B (FIG. 18) defines a substantially square cross section symmetrically located on support 36B, but first surface 114B is planar while second surface 116B is concavely arcuately-shaped. In armrest body 38B, when armrest body 38B is rotated, surface 116B is positioned in substantially an identical spacial position as previously occupied by surface 114B. Armrest body 38B illustrates that various faces on the body can be selectively positioned in an identical use position by rotation of armrest body 38B. For example, first surface 114B could provide a cushioned fabric support surface, while second surface 116B could provide a rigid hard support surface. Alternatively, the first surface 114B could provide an armrest support, while surface 116B could include a container holder depression or a pencil holder tray.

Armrest body 38C (FIG. 19) has a vertically elongated rectangular shape, and support 36 is offset vertically so that the first surface 114C when in the first position is vertically offset from the spacial position of second surface 116C when in the second position. Armrest body 38D (FIG. 20) positions support 36 at a diagonally offset position, and body 38D is rectangularly shaped. Thus, first surface 114D when in the first position is diagonally offset from second surface 116D when in the second position. Armrest body 38E (FIG. 21) includes a trapezoidally-shaped cross section wherein first surface 114E is horizontally oriented when in the first position, and second surface 116E is diagonally angled when in the second position. Armrest body 38 (FIG. 22) is also trapezoidally-shaped, but both first surface 114F and second surface 116F are diagonally oriented when positioned in their respective use positions, although the surfaces are oriented in opposing angular directions when in use.

In all of armrest bodies 38A–38F, surfaces 114A–114F and 116A–116F are shown as planar, but is contemplated that various complexly-shaped surfaces would be formed on the armrest body such as illustrated by three dimensionally contoured surfaces 114 and 116 on armrest body 38, for example. Further, by placing detents and/or locking members at notches 44 and/or protrusions 40, additional stability of the armrest body can be achieved. Still further, by locating notches at various circumferential positions on bore 108, additional surfaces on an armrest body can be positioned to interface with a user or, alternatively, a single surface can be positioned at various angles. For example, it is contemplated that an armrest body could be positioned at four different positions, each 90° from adjacent positions, with the armrest body being rotatable 360° as it is moved along a zigzag-shaped path around a three dimensional depression in the armrest body.

Figure 30:
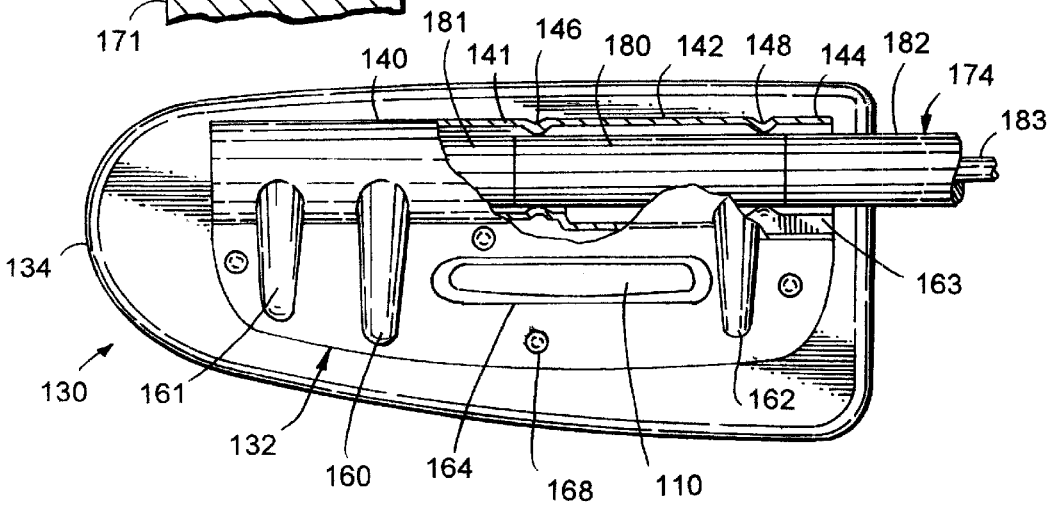
FIG. 30 is a plan view showing the molding process for molding RIM material onto the reinforcement insert.

A modified armrest body 130 (FIGS. 27 and 30) includes a one-piece sheet metal reinforcement insert 132 and a molded on cushion 134 made from self-skinning, foamed, resilient urethane material, such as reaction injection molded (RIM) material. The outer appearance of body 130 is generally identical to body 38, but body 130 substantially eliminates the need for coating the body halves (80 and 82) with RIM material to eliminate the parting line extending around the armrest body 38. Body 130 is configured to mateably engage support 36 in a manner generally identical to the manner in which body 38 engages support 36.

Insert 132 (FIGS. 23–26) includes a tubular portion 136 and a flange portion 138. Tubular portion 136 includes a long, straight section 140, a configured depression defining section 142 and a short, straight section 144, all axially aligned. Vent holes 141 are located along long tubular section 140 for venting RIM material, as described hereinafter. Configured section 142 is connected to long, straight section 140 at one end by a ring-shaped, circumferentially extending embossment or rib 146 and is connected to short, straight section 144 at its other end by a ring-shaped, circumferentially extending embossment or rib 148. Configured section 142 includes a semi-cylindrical surface 150 that is axially aligned with long, straight section 140 and short, straight section 144, and which is co-linear with the surfaces of sections 140 and 144. A rack-defining semi-cylindrical surface 154 is formed in configured section 142 opposite semi-cylindrical surface 150. It is noted that configured section 142 forms a configured recess that corresponds generally to the section of bore 108 including depression 42 in armrest body 38 (FIG. 2).

Figure 27:
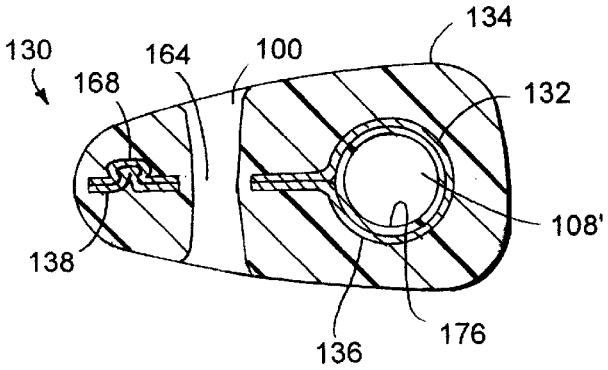
FIG. 27 is a cross-sectional view of the modified armrest body including the reinforcement insert shown in FIG. 24 and further including self-skinning foamed cushion material formed on the insert.

Semi-cylindrical depressed surface 154 (FIGS. 23–26) extends about 80° on each side of flange portion 138. A series of notches 156 and 158 (FIG. 26) are formed at the edges of semi-cylindrical depressed surface 154 for receiving the protrusions of a support (36). Opposing pairs of diagonal reinforcement ribs 160 and 161 (FIGS. 23–25) extend from long, straight section 140 onto flange portion 138, and another pair of diagonal reinforcement ribs 162 extend from configured section 142 adjacent embossment 148 onto flange portion 138. Short tubular section 144 also includes keyway 163. An elongated aperture 164 is formed generally in the center of flange portion 138 and extends longitudinally in flange portion 138 in a direction parallel bore 108' of insert 132. Flange portion 138 includes opposing flange panels 166 and 167 at lay against each other and are toggle locked together or otherwise secured together, such as by welding, rivets, adhesive, etc. An exemplary toggle lock location 168 is shown in FIG. 27. It is noted that the process of toggle locking is known in the art.

Figure 28:
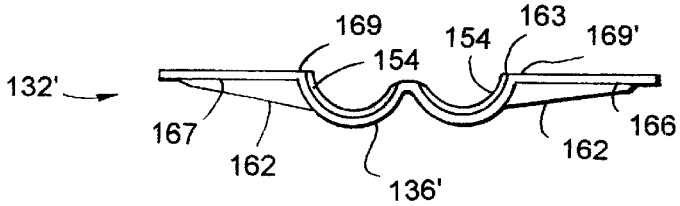
FIG. 28 is an end view of a partially formed sheet metal blank for making the reinforcement insert shown in FIG. 23.
Figure 29:
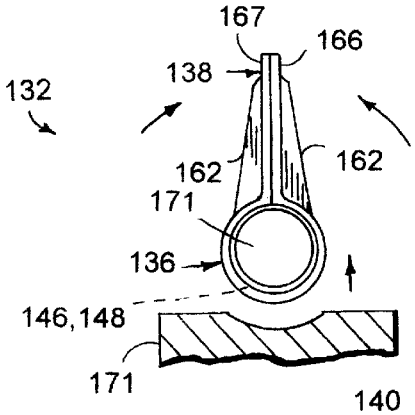
FIG. 29 is an end view of the blank shown in FIG. 28 after bolding opposing edges together to form the tube section of the insert.

Insert 132 comprises a one-piece blank 132' (FIG. 28) stamped from the flat sheet metal stock, although it is contemplated that the present invention also includes an insert and could be molded or assembled from multiple pieces, such as by welding a sheet metal flange onto a configured tube. The tubular portion of insert 132 is initially partially formed in the center 136' of the blank 132' (FIG. 28), including formation of such features as rack-defining semi-cylindrically shaped surface 154 and the bends 169 and 169', which connect flange panels 166 and 167 to tubular portion 136'. Embossed ribs 160, 161 and 162 and opposing halves of keyway slot 163 are further stamped into the blank. The blank 132' is then wrapped around a mandrel 170 (FIG. 29) to form tubular portion 136 such that opposing flange panels 166 and 167 are brought into abutting contact. Cylindrical ribs 146 and 148 are then fully formed by an embossing die 171 while the sides of tubular portion 136 is supported, and flange panels 166 and 167 are toggle locked together to form a rivet-like connection. Apertures 164 can be stamped in flange portion 138 after flanges 166 and 167 are mated together, or before. Further, a flange (not specifically shown) can be formed in one of flange panels 166 and 167, either adjacent aperture 164 or at the perimeter of the panels, and bent around onto the other of flange panels 166 and 167 to hold the panels together. In such case, fewer toggle locked or spot welded connections would need to be made.

Next, a mandrel or plug 174 (FIG. 30) is placed in an end of bore 108'. Mandrel 174 includes a resilient sleeve 180 positioned between opposing rod-shaped mandrel members 181 and 182. A pull rod 183 extends through mandrel member 182 and resilient sleeve 180 and connects to inner mandrel member 181. Members 180, 181 and 182 define a continuous outer diameter for forming bore 108, but resilient sleeve 180 is configured to bulge slightly when pull rod 183 is tensioned and mandrel members 181 and 182 are clamped against resilient sleeve 180. As resilient sleeve 180 bulges, it seals against circumferential embossments 146 and 148, thus preventing (RIM) material from entering configured section 142 so that it closely engages circular ribs 146 and 148. Mandrel 174 extends to the end of long tubular section 140 so that the bore 108 formed in armrest body 130 is continuous to the end of insert 132. The mandrel 174 also includes a protrusion 176 for plugging keyway slot 163 to prevent the (RIM) material from entering the configured section 142 of the bore 108' of reinforcement insert 132. Insert 132 is enclosed in a pair of mating RIM molding dies, and the (RIM) material is injected around reinforcement insert 132 such that it foams and also self-skins to form the resilient cushion 134. The RIM material enters the narrow space between long, straight section 140 and the mandrel 174, and also enters the space between short, straight section 144 and the mandrel 174. The self-skinning nature of the (RIM) material forms an effective bearing surface along the ends of bore 108' for slidingly, rotationally supporting support 36. The foaming RIM material is blocked from entering configured section 142 by cylindrically-shaped depressions 146 and 148. Vent hole 141 allows air to escape from long tube section 140 so that the RIM material 178 fills the space between mandrel 174' and long tubular section 140.

Thus, an armrest is provided having a multi-faced body that can be readily selectively repositioned to position the individual faces of the body for use. In the foregoing description, it will be readily appreciated by those skilled in the art that modifications may be made to the invention without departing from the concepts disclosed herein. Such modifications are to be considered as covered by the following claims, unless these claims by their language expressly state otherwise.

The embodiments of the invention in which an exclusive property or privilege is claimed are defined as follows:

1. An armrest structure for a chair comprising:

a support having a tubular section defining an axis and at least one radially extending protrusion on the tubular section; and an armrest body including a reinforcement insert defining a configured recess shaped to rotatably receive the tubular section and operatively engage the protrusion, and further including a polymeric body covering the reinforcement insert having a plurality of relatively flat user interface faces defined thereon adapted to comfortably support a person's forearm, each face being spaced from and having a predetermined angular relation to the configured recess and the protrusion so that said armrest body can be selectively positioned to locate the faces, one at a time, in respective operative arm-supporting adjusted positions for use by a user.

2. An armrest structure as defined in claim 1 wherein said polymeric body includes bearing structure configured to rotatably engage said support for rotation about said axis on said support.

3. An armrest structure as defined in claim 2 including an arm connected to said support, said arm being configured for attachment to a chair so that said axis extends generally horizontally.

4. An armrest structure as defined in claim 3 wherein said reinforcement insert includes rotation-limiting structure limiting the rotation of said armrest body on said support to a stroke of less than 180° of rotation.

5. An armrest structure as defined in claim 4 wherein said rotation-limiting structure limits said stroke to less than 160°.

6. An armrest structure as defined in claim 2 wherein said bearing structure longitudinally slidably engages said support.

7. An armrest structure as defined in claim 1 wherein said armrest body includes a concave depression therein.

8. An armrest structure as defined in claim 7 wherein said concave depression is configured to hold an article therein.

9. An armrest structure as defined in claim 1 wherein said plurality of user interface faces includes a fabric covered first surface and a non-fabric covered second surface, each being selectively positionable in operative positions for use.

10. An armrest structure as defined in claim 1 wherein said plurality of user interface faces includes first, second and third surfaces positionable in respective operative use positions.

11. An armrest structure defined in claim 1 wherein the tubular section extends horizontally, and wherein the reinforcement insert and the polymeric body have a combined center of gravity that is offset from the axis of the tubular section when in a selected one of the adjusted positions so that the armrest body is held in the selected one of the adjusted positions at least in part by gravity.

12. An armrest structure as defined in claim 1, wherein said plurality of faces includes a first face and a second face, and wherein said first face when in a first one of the arm-supporting positions is spaced horizontally from said second face when in a second one of the arm-supporting positions.

13. An armrest structure as defined in claim 12 wherein said first face when in said first arm-supporting position is spaced vertically from said second face when in said second arm-supporting position.

14. An armrest structure as defined in claim 1, wherein said plurality of faces includes a first face and a second face, and wherein said first face when in a first one of the arm-supporting positions is spaced vertically from said second face when in a second one of the arm-supporting positions.

15. An armrest structure as defined in claim 1 wherein said tubular section includes a free end, and said body is rotatably/slidably attached to said free end.

16. An armrest structure as defined in claim 15 wherein said support is configured for attachment to a chair and the tubular section extends generally horizontally, and wherein said operative positions include a first position and a second position, said body when in said first position being pivoted inwardly with respect to said tubular section for supporting a user's arm substantially inwardly from an inner side of the tubular section and when in said second position being pivoted outwardly with respect to said tubular section for supporting the user's arm substantially outwardly from an outer side of the tubular section.

17. An armrest structure as defined in claim 15 wherein one of said body and said support includes a notched channel defining at least first, second and third discrete operative positions.

18. An armrest structure as defined in claim 15 wherein said body is telescopingly slidably attached to said support.

19. An armrest structure as defined in claim 1 wherein said armrest body comprises a molded body that has a cross section, the configured recess being located offset from a center of the cross section so that the armrest body is displaced when the armrest body is rotated on the tubular section.

20. An armrest structure as defined in claim 1 wherein said armrest body includes a vertically open aperture therein extending through said armrest body and that is offset from said support.

21. An armrest structure as defined in claim 20 wherein said aperture forms a fingerhold.

22. An armrest for an office chair comprising:

a support with one end adapted for attachment to a chair and a tubular section extending from the one end at an angle to position the tubular section adjacent a side of the chair, the tubular section including a radially extending protrusion having a predetermined diameter; and an armrest body including an insert defining a configured recess shaped to receive the tubular section and a flange extending from the configured recess, the configured recess defining a channel with circumferentially extending side notches shaped to slidably receive the protrusion, the notches each defining an arcuate path so that the protrusion is selectively movable into and out of said notches by rotating said armrest body on said support, at least some of the notches being oriented and positioned in the configured recess so that a weight of the armrest body assists in holding the protrusion in a selected one of the side notches by gravity.

23. An armrest for an office chair comprising:

a support having a tubular section and at least one radially extending protrusion; and an armrest body including an insert defining a configured recess, and further including a molded polymeric body covering the insert, the configured recess defining a tubular cavity having a length and spaced apart ring-shaped surfaces along the length, and the molded polymeric body including molded material in the tubular cavity forming bearing surfaces therein up to the ring-shaped surfaces, said bearing surfaces slidably engaging and supporting the tubular section, the configured recess also defining a slot operably receiving the protrusion, so that the armrest body can be moved to selected positions on the tubular section by selectively engaging the protrusion with parts of the slot.

24. An armrest structure comprising:

an armrest body having a configured recess, the configured recess including a bore-shaped recess defined by a cylindrically shaped first surface with a first diameter and a longitudinal axis, a circumferentially extending second surface having a larger second diameter so as to define a radially extending recess in the first surface that extends partially around and partially along the longitudinal axis, and notch-defining surfaces that extend between the first and second surfaces to form stops; and a support including a cylindrically shaped third surface having the first diameter and that slidably engages the first surface so that the armrest body is rotatable on the support, and including a radially extending protrusion configured to selectively abut the notch-defining surfaces to limit the rotation of the armrest body on the support.

25. The armrest structure defined in claim 24 wherein the radially extending recess is longitudinally elongated so that the armrest body can slide longitudinally on the support without interference from the protrusion.

26. The armrest structure defined in claim 24 wherein the cylindrically shaped first surface includes a ring-shaped portion that forms an elongated bearing surface that completely surrounds the support for providing stability to the armrest body during rotation, and further includes a semi-cylindrical portion adjacent the ring-shaped portion that forms an additional bearing surface that also provides stability to the armrest body during rotation.

27. An armrest structure comprising:

an elongated support;

an adjustable armrest body rotatable about a longitudinal axis and mounted on said support for movement between at least two positions in which the armrest body is horizontally displaced so that a user can adjust the armrest body relative to the support for increased comfort when the armrest structure is mounted to a chair;

a pair of opposed stops disposed on one of said support and said body, said stops being positioned to correspond to said two horizontally displaced positions;

a stop engaging member disposed on the other of said support and said body, said stop-engaging member being configured to engage the stop corresponding to a selected one of said two positions when said armrest body is rotated into a selected one of said two horizontally displaced positions; and an arm connected to said support, said arm including a laterally inwardly extending end section configured for connection to a chair under a seat of the chair, said armrest body when in a first one of said displaced positions being pivoted inwardly with respect to said end section, and when in a second one of said displaced positions being pivoted outwardly with respect to said end section.

28. An armrest structure as defined in claim 27 wherein said support defines a generally horizontally extending axis, and said armrest body is configured to rotate about said axis on said support.

29. An armrest structure as defined in- claim 27 wherein said armrest body telescopingly slidably engages said support.

30. An armrest structure as defined in claim 27 wherein said stop-engaging member includes a protrusion for selectively engaging said pair of opposed stops.

31. An armrest structure as defined in claim 30 including additional stops for defining additional positions of said armrest body on said arm support.

32. An armrest structure as defined in claim 31 wherein said pair of opposed stops each comprises portions of a notched channel.

33. An armrest structure as defined in claim 27 wherein said armrest body includes first and second surfaces, and said operative positions include a first position and a second position, the position of said first surface when in said first position being different than said second surface when in said second position.

34. An armrest structure as defined in claim 27 wherein said stop-engaging member is located on said support.

35. An armrest structure as defined in claim 34 wherein said stop-engaging member includes at least one protrusion.

36. An armrest structure comprising:

a support, at least a portion thereof extending substantially horizontally;

an armrest body telescopingly, slidably and pivotably attached to the horizontally disposed portion of said support for movement between a plurality of operative positions;

a pair of opposed stop racks disposed on one of said support and said body, said stop racks being positioned so as to define a plurality of selectable positions on each of said racks, each selectable position corresponding to a particular one of said plurality of operative positions for said body; and a stop engaging member disposed on the other of said support and said body, said stop-engaging member being configured to engage a selected one of said plurality of selectable positions on one of said stop racks corresponding to a selected one of said plurality of operative positions for said body when said body is pivoted into a corresponding selected one of said operative positions.

37. An armrest structure as defined in claim 36 including an arm connected to said support, said arm being configured for attachment to a chair so that said support extends generally horizontally.

38. An armrest structure as defined in claim 36 wherein said pair of opposed stop racks include a notched slot, and said stop-engaging member includes at least one protrusion for engaging selected locations on said notched slot.

39. An armrest structure as defined in claim 36 wherein said armrest body defines a first surface and a second surface, said operative positions including a first position for locating said first surface in a use position and a second position, and wherein the spacial position of said first surface when in said first position is spatially different than said second surface when in said second position.

40. A chair assembly comprising:

a chair having a seat with a side edge; and an adjustable armrest attached to the chair including a support with a generally horizontally oriented tubular section having a forwardly extending free end, and an armrest body rotatably mounted on the free end of the tubular section, said armrest body moveable between a first position wherein a first surface of the armrest body is oriented generally over and partially inboard of the side edge of the chair for supporting a user's forearm, and a second position wherein a second surface of the armrest body is oriented generally over and partially outboard of the side edge of the chair for supporting the user's forearm and further wherein said second position has a rotational orientation different from said first position with respect to the chair, said free end being spaced above the seat so that a user can move their legs partially under the armrest while seated in the chair.

41. A chair assembly as defined in claim 40 wherein the armrest is longitudinally adjustable on the tubular section.

42. A chair assembly as defined in claim 40 wherein one of the tubular section and the armrest body include a slot with side notches, and the other includes a protrusion, the protrusion being selectively positionable in the side notches and movable along the slot so that the armrest body can be secured in a selected one of the first and second positions through use of the protrusion and slot.

43. An armrest structure comprising:

an inverted L-shaped support having a vertical section and a horizontal section with a free end defining a generally horizontally extending axis;

an armrest body having a configured recess for rotatably engaging said free end and, said armrest body being movably supported on said support for rotation about said axis, said armrest body including a first surface for supporting a user's arm and a second surface also for supporting the user's arm that is circumferentially spaced from said first surface; and said support and said armrest body including first and second rotation limiting members that are selectively engagable to hold said armrest body in a first rotational position where the first surface is positioned in a first location for use and that are further selectively engagable to hold said armrest body in a second rotational position where the second surface is positioned in a second location for use, the first location being horizontally spaced from the second location.

44. An armrest structure as defined in claim 43 wherein said rotation limiting members include a slot and a protrusion configured to selectively engage said slot.

45. An armrest structure as defined in claim 44 wherein said slot includes a notched channel.

46. An armrest structure as defined in claim 44 wherein said armrest body includes said slot and said support includes said protrusion.

47. An armrest body for a chair comprising:

a reinforcement insert including a tubular portion defining a configured recess with at least one stop therein, and including a flange portion; and an aesthetic bulbously-shaped covering material substantially encapsulating said reinforcement insert.

48. An armrest body as defined in claim 47 wherein said tubular portion defines a bore, that is partially filled with the material of said covering material.

49. An armrest body as defined in claim 47 wherein said tubular portion is configured to operably engage a support for rotatably supporting said armrest body.

50. An armrest body as defined in claim 47 wherein said reinforcement insert defines an aperture in said flange portion, and said covering material defines an opening corresponding to the aperture.

51. An armrest body as defined in claim 47 wherein said covering material and said flange portion define aligned apertures defining a finger hold on said armrest body.

52. An armrest body as defined in claim 47 wherein said covering material includes reaction injected molding material.

53. An armrest body as defined in claim 52 wherein said insert comprises a stamped sheet metal part.

54. An armrest body as defined in claim 47 wherein said reinforcement insert comprises a stamping.

55. An armrest body as defined in claim 54 wherein said insert comprises a stamped sheet metal part.

56. An armrest body as defined in claim 55 wherein said insert includes mating opposing panels and an intermediate portion, said intermediate portion defining said tubular portion.

* * * * *

UNITED STATES PATENT AND TRADEMARK OFFICE

CERTIFICATE OF CORRECTION

PATENT NO. : 6,554,364 B1
DATED : April 29, 2003
INVENTOR(S) : Arnold B. Dammermann et al.

It is certified that error appears in the above-identified patent and that said Letters Patent is hereby corrected as shown below:

Column 1,
Line 19, “entirely” should be -- entirety --;
Line 41, before “it”, delete “. (period)”;
Line 49, “tying” should be -- typing --;

Column 2,
Line 16, “take n” should be -- taken --;
Line 59, “”bolding” should be -- folding --;

Column 3,
Line 44, after “56”, delete “. (period)” and insert -- for --;

Column 7,
Line 50, before “bore”, insert -- to --;

Column 9,
Lines 45-46, “one of the adjusted positions” should be -- one adjusted position --;

Column 11,
Line 56, after “in”, delete “- (hyphen)”;

UNITED STATES PATENT AND TRADEMARK OFFICE

CERTIFICATE OF CORRECTION

PATENT NO. : 6,554,364 B1
DATED : April 29, 2003
INVENTOR(S) : Arnold B. Dammermann et al.

It is certified that error appears in the above-identified patent and that said Letters Patent is hereby corrected as shown below:

Column 13,
Lines 12-15, "an armrest body . . . surface; and" should be -- an armrest rotatable about a longitudinal axis and having a longitudinally extending recess coincident with said longitudinal axis, said armrest body recess rotatably engaging said free end and, said armrest body being movably supported on said support and rotatable about said longitudinal axis, said armrest body including a first surface for supporting a user's arm and a second surface also for supporting the user's arm that is circumferentially spaced from said first surface and --.

Signed and Sealed this

Twenty-fifth Day of November, 2003

JAMES E. ROGAN
*Director of the United States Patent and Trademark Office*